US012152511B2

(12) United States Patent
Karlin et al.

(10) Patent No.: US 12,152,511 B2
(45) Date of Patent: Nov. 26, 2024

(54) ROCKER ARM VALVE MECHANISM

(71) Applicant: Gnutti Carlo Sweden AB, Hisings Backa (SE)

(72) Inventors: Michael Karlin, Skövde (SE); Ulric Lindberg, Gothenburg (SE); Johan Sjögren, Kungsör (SE); Johan Mohlin, Lidköping (SE)

(73) Assignee: GNUTTI CARLO SWEDEN AB, Hisings Backa (SE)

( * ) Notice: Subject to any disclaimer, the term of this patent is extended or adjusted under 35 U.S.C. 154(b) by 0 days.

(21) Appl. No.: 18/257,059

(22) PCT Filed: Dec. 10, 2021

(86) PCT No.: PCT/SE2021/051233
§ 371 (c)(1),
(2) Date: Jun. 12, 2023

(87) PCT Pub. No.: WO2022/131996
PCT Pub. Date: Jun. 23, 2022

(65) Prior Publication Data

US 2024/0052763 A1 Feb. 15, 2024

(30) Foreign Application Priority Data

Dec. 18, 2020 (SE) ..... 2051487-3

(51) Int. Cl.
*F01L 1/24* (2006.01)
*F01L 1/18* (2006.01)
*F01L 13/06* (2006.01)

(52) U.S. Cl.
CPC ..... *F01L 1/2411* (2013.01); *F01L 1/181* (2013.01); *F01L 2001/2438* (2013.01); *F01L 13/06* (2013.01); *F01L 13/065* (2013.01)

(58) Field of Classification Search
CPC . F01L 1/181; F01L 1/2411; F01L 2001/2438; F01L 13/06; F01L 13/065
(Continued)

(56) References Cited

U.S. PATENT DOCUMENTS

2011/0073068 A1 3/2011 Yoon et al.
2020/0182098 A1 6/2020 McCarthy, Jr. et al.

FOREIGN PATENT DOCUMENTS

CN 203097985 U * 7/2013
CN 111691942 A * 9/2020 ..... F01L 1/18
(Continued)

*Primary Examiner* — Jorge L Leon, Jr.
(74) *Attorney, Agent, or Firm* — Fay Kaplun & Marcin, LLP

(57) ABSTRACT

A valve mechanism system in a hydraulic rocker arm for a combustion engine includes a check valve spring, a check valve ball and a control piston. The spring contacting the ball are arranged in a seat in a recess in the arm. The recess has a first opening to a rocker arm channel connected to a hydraulic element and a second opening to a rocker arm oil supply via a second channel. The piston has a first end with a pin axially aligned with the piston arranged in contact with the ball on the opposite side of the ball from the spring. The ball is movable between a first position allowing oil to flow to and from the oil supply and a second position stopping oil from flowing between the two channels. A control piston spring is arranged on a second end of the piston such that it biases the piston towards the ball. The piston in an axial direction is movably arranged in a cylinder shaped cartridge and the cartridge has a first end arranged towards the outside of the arm and a second end in the axial direction opposite inner end. The cartridge is arranged in the recess in the arm.

7 Claims, 2 Drawing Sheets

(58) Field of Classification Search
USPC ..... 123/90.16, 90.39, 90.44, 90.46
See application file for complete search history.

(56) References Cited

FOREIGN PATENT DOCUMENTS

| | | | | | |
|---|---|---|---|---|---|
| JP | 5688906 | U | | 7/1981 | |
| WO | WO-2015177127 | A1 | * | 11/2015 | ..... F01L 1/181 |
| WO | 2017/160379 | A1 | | 9/2017 | |
| WO | 2017/197044 | A1 | | 11/2017 | |
| WO | 2019/120556 | A1 | | 6/2019 | |
| WO | WO-2020202094 | A1 | * | 10/2020 | ..... F01L 1/181 |

* cited by examiner

ROCKER ARM VALVE MECHANISM

TECHNICAL FIELD

The present invention relates to a valve mechanism system in a hydraulic rocker arm for a combustion engine, comprising a check valve spring and a check valve ball. Said spring is arranged to be in contact with the check valve ball and wherein said spring and ball are arranged in a seat in a recess in the rocker arm. The recess has a first opening to a rocker arm channel connected to a hydraulic element (piston) and a second opening to a rocker arm oil supply via a second channel.

The system further comprises a control piston having a first end with a pin axially aligned with the control piston arranged in contact with said check valve ball on the opposite side of the check valve ball from the check valve spring. The check valve ball is movable between a first position allowing oil to flow to and from the oil supply and a second position stopping oil from flowing between the two channels. A control piston spring is arranged on a second end of the control piston such that it biases the control piston towards the check valve ball.

BACKGROUND

The role of the decompression release exhaust brake, hereafter called engine brake, is to convert a power-producing engine into a power-absorbing retarding mechanism and the valve train is a significant part of this mechanism. The engine braking mechanism for a four-stroke diesel engine is as follows. On the normal intake stroke, the intake valve opens, and air is forced into the cylinder by boost pressure from the turbocharger. Then, in the compression stroke, air is compressed by the engine piston.

The energy required to compress this air is produced by the driving wheels of the vehicle. Near top dead center, the engine brake opens the exhaust valves, venting high-pressure air and dissipating the stored energy through the exhaust system. On the downward stroke, essentially no energy is returned to the piston and to the driving wheels. There is a loss of energy and this loss is how the retarding work is accomplished.

The timing of the valve opening event is important because the piston at top dead center has done the maximum amount of work. If the valve is opened early, not much power will be absorbed. Similarly, if the valve is opened after top dead center, some power has been returned to the crank by the compressed air. As the valve opening event moves away from top dead center, the engine brake becomes less effective. In practice, it is necessary to use a cam or rocker motion that occurs close to top dead center for timing the valve opening event.

One common characteristic of all engine brakes is that retarding power increases as engine revolutions per minute increase. In general, the same things that affect retarding performance are engine displacement, compression ratio, turbo boost, and the timing of the valve opening event. In its simplest description, the engine brake converts a diesel engine into an air compressor. Higher compression ratios producing higher cylinder pressures would result in higher retarding performance.

For the engine brake to function correctly, the valve lash must be eliminated. The lubrication system of the engine is used for this purpose. It activates a power piston in the exhaust rocker arm by means of a solenoid valve in the cylinder head and this piston eliminates the valve lash. The lower part of the piston is in contact with the exhaust valves either directly or through intermediate components e.g. ball socket and valve bridge.

During normal operation, the oil supply pressure in the rocker shaft is low and the power piston stays in its original position. The control piston is resting against the check valve ball and prevents it from closing. No hydraulic lock is created.

When the engine brake is activated, the oil supply pressure in the rocker shaft is raised by the solenoid valve in the cylinder head and the control piston moves away from check valve ball enabling it to close against the valve seat. The power piston moves outward and eliminates the valve lash. When the brake lift cam event starts, the check valve closes and creates a hydraulic lock between cam lobe and exhaust valves. The camshaft is now in direct contact with the exhaust valves, and the extra cams provides the engine brake lift events.

To deactivate the engine brake, the solenoid valve lowers the rocker shaft oil supply pressure whereby the control piston pin opens the check valve. The hydraulic lock is eliminated, power piston retracts which increases valve lash and there are no brake lift events available.

Optionally, a pressure-limiting valve is built into the power piston, which opens to drain oil if the oil pressure becomes abnormally high. Previously, it was the driver's job to ascertain the correct transmission gear to use, depending on, for example, the steepness of the grade and the truck's load. However, the job of the driver has to a large extent been taken over by the powertrain and vehicle control system.

Various improvements have been made and development is ever ongoing, especially to reduce fuel consumption. Higher power density and faster response are goals that lead to new challenges.

SUMMARY

The present invention relates to a control valve for a diesel compression release exhaust brake system and/or a variable valve train system.

According to a first aspect of the present disclosure a valve mechanism system in a hydraulic rocker arm for a combustion engine, comprises a check valve spring and a check valve ball. Said spring is arranged to be in contact with the check valve ball and wherein said spring and ball is arranged in a seat in a recess in the rocker arm. The recess has a first opening to a rocker arm channel connected to a hydraulic element and a second opening to the rocker arm oil supply via a second channel.

The system further comprises a control piston having a first end with a pin axially aligned with the control piston arranged in contact with said check valve ball on the opposite side of the check valve ball from the check valve spring. The check valve ball is movable between a first position allowing oil to flow to and from the oil supply and a second position stopping oil from flowing between the two channels. A control piston spring is arranged on a second end of the control piston such that it biases the control piston towards the check valve ball.

The control piston is in an axial direction movably arranged in a cylinder shaped cartridge and the cartridge has a first end arranged towards the outside of the rocker arm and a second end in the axial direction opposite inner end. The cartridge is arranged in said recess in the rocker arm.

One of the advantages of having a cartridge is that the parts inside the cartridge can be preassembled and arranged in the cartridge which leads to a faster assembly of the rocker arm.

According to one alternative of the present disclosure, the hydraulic element is a piston.

According to a further aspect of the present disclosure, the second end of the cartridge has an opening that is larger than the pin of the control piston and smaller than the control piston. More specifically, the opening of the cartridge has a diameter that is larger than the diameter of the pin of the control piston but a smaller than the diameter of the control piston such that the piston won't fall out of the cartridge before assembled in the rocker arm.

According to yet a further aspect of the present disclosure the outside of the second end of the cartridge has a seat for the check valve ball. The seat facilitates for the check valve ball to be positioned in the correct position and thus minimizes leakage.

According to another aspect of the present disclosure the cartridge comprises two parts, a first part comprising the first end with an inside cylinder shape to house the control piston and a second seat part comprising the second end having at least one opening for allowing oil to flow to and from a rocker arm oil supply via the second opening in the recess.

By having the cartridge be made out of two parts, with one part comprising the first end with its inside cylinder shape arranged to house the control piston and with the second seat part comprising the second end, production is facilitated.

According to yet another aspect of the present disclosure, the cartridge comprises an outer circumferential ledge, the surface of which is perpendicular to an axial extension of said cartridge, and a mating seat provided in the rocker arm. By pressing the cartridge in the axial direction into the recess the ledge of the cartridge will be pressed against the axially perpendicular plane of the seat and thus create a tight seal. Generally, similar prior solutions are secured to a recess by a press fit for achieving a seal. Alternatively, the surface of the outer circumferential ledge and the mating seat provided in the rocker arm are both conical. Thus, the mating of the surfaces provide a guiding function as well as a sealing function.

According to an alternative aspect of the present disclosure, when the cartridge comprises two parts, i.e. a first part comprising the first end with an inside cylinder shape to house the control piston and a second seat part comprising the second end having at least one opening in a radial direction for allowing oil to flow to and from a rocker arm oil supply via the second opening in the recess, the second seat part of the cartridge comprises an outer circumferential ledge, the surface of which is perpendicular to an axial extension of said cartridge, and a mating seat provided in the rocker arm. Similarly, by pressing the cartridge in the axial direction into the recess the ledge of the cartridge will be pressed against the axially perpendicular plane of the seat and thus create a tight seal. As stated above, similar prior art solutions are secured to a recess by a press fit for achieving a seal.

According to a preferred aspect of the present disclosure, the cartridge has outer threads for engaging with inner threads of the recess in the rocker arm. This facilitates achieving a desired pressure of the cartridge to the recess for an efficient seal.

According to an alternative preferred aspect of the present disclosure, the first part of the cartridge has outer threads for engaging with inner threads of the recess in the rocker arm.

According to a further aspect of the present disclosure the first end of the cartridge has a structure allowing for engagement with a tool. For instance, the structure could be compatible with a torx key such that the cartridge could be screwed into the recess of the rocker arm.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
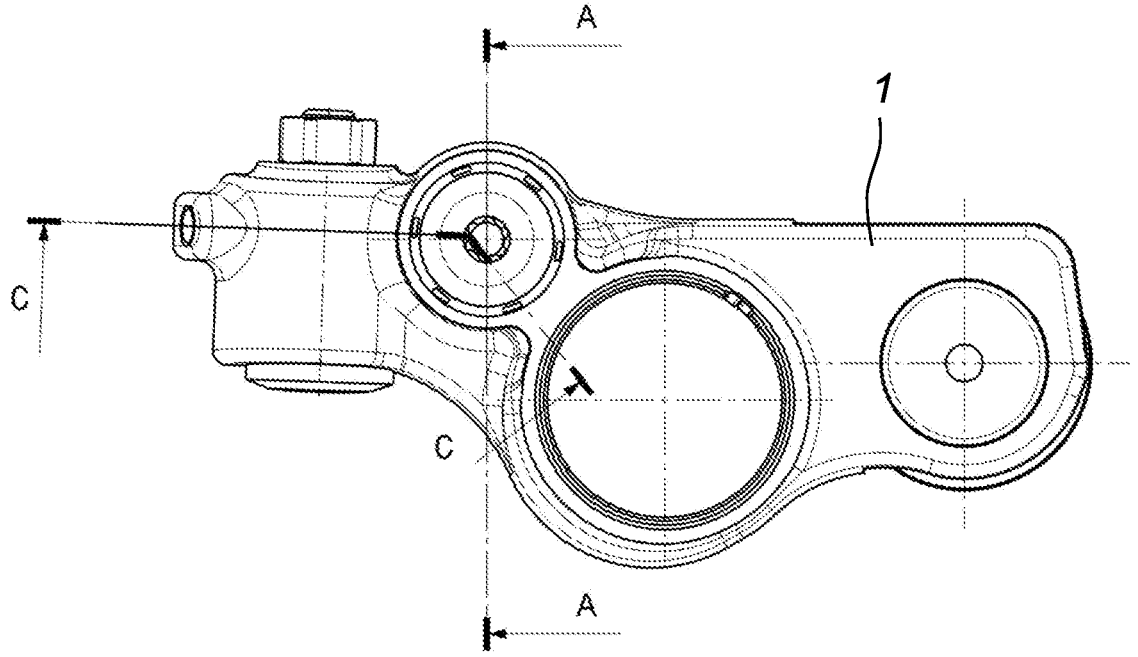
FIG. 1 is a view of a rocker arm.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

With reference to FIG. 1 a rocker arm 1 is shown together with cross section lines A-A and C-C.

Figure 2:
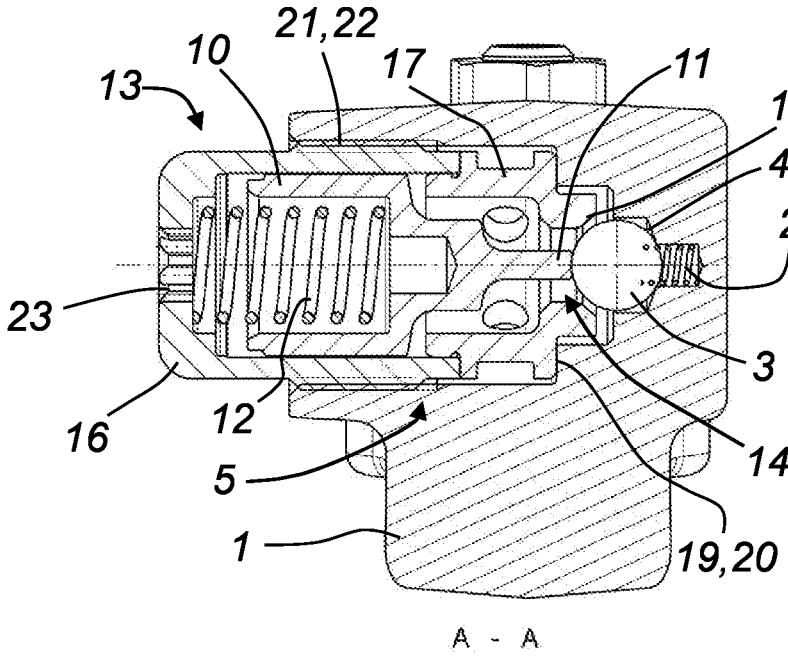
FIG. 2 is a cross section along the line A-A of FIG. 1.
Figure 3:
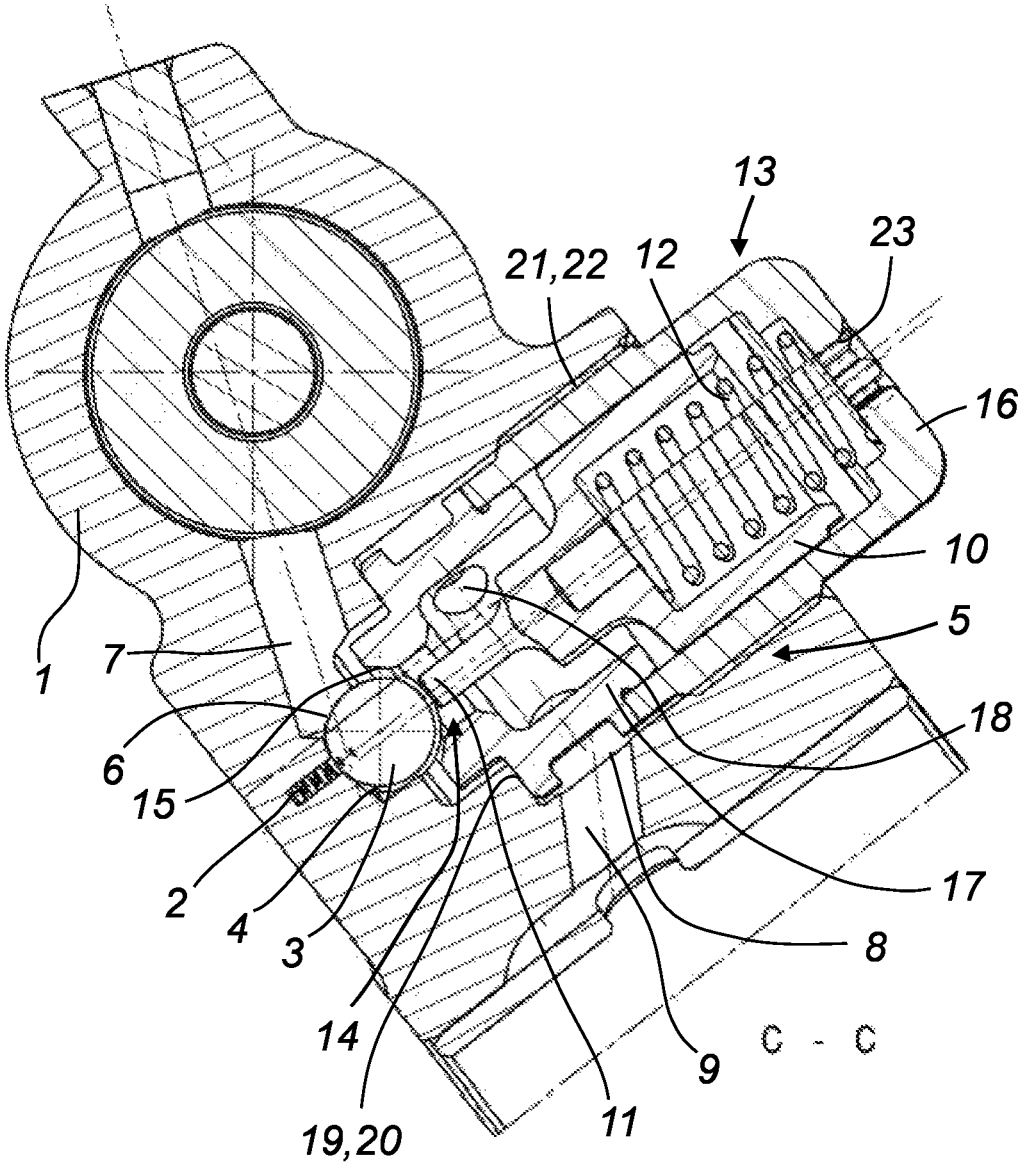
FIG. 3 is cross section along the line C-C of FIG. 1.

FIG. 2 relates to the cross section A-A and FIG. 3 to cross section C-C. FIG. 3 shows a valve mechanism system in a hydraulic rocker arm 1 for a combustion engine, comprising a check valve spring 2 and a check valve ball 3. Said spring 2 is arranged in contact with the check valve ball 3 and said spring 2 and ball 3 are arranged in a seat 4 in a recess 5 in the rocker arm 1.

The recess 5 has a first opening 6 to a rocker arm channel 7 connected to a hydraulic element and a second opening 8 to a rocker arm oil supply via a second channel 9. The system further comprises a control piston 10 having a first end with a pin 11 axially aligned with the control piston 10 arranged in contact with said check valve ball 3 on the opposite side of the check valve ball 3 from the check valve spring 2.

The check valve ball 3 is movable between a first position allowing oil to flow to and from the oil supply and a second position stopping oil from flowing between the two channels 7, 9. A control piston spring 12 is further arranged on a second end of the control piston 10 and biases the control piston 10 towards the check valve ball 3.

The control piston 10 is in an axial direction movably arranged in a cylinder shaped cartridge 13 and the cartridge has a first end arranged towards the outside of the rocker arm 1 and a second end in the axial direction opposite inner end. The cartridge is arranged in said recess 5 in the rocker arm 1.

As further can be seen in FIGS. 2 and 3, the second end of the cartridge 13 has an opening 14 that is larger than the diameter of the pin 11 of the control piston 10 and smaller than the control piston diameter. Also, the outside of the second end of the cartridge has a seat 15 for the check valve ball 3.

In the shown embodiment, the cartridge 13 comprises two parts. A first part 16 comprises the first end with an inside cylinder shape to house the control piston 10 and a second seat part 17 that comprises the second end having at least two or more openings 18 for allowing oil to flow to and from a rocker arm oil supply via the second opening 8 in the recess.

Further, the cartridge 13 comprises an outer circumferential ledge 19 with an axially perpendicular plane and a corresponding axially perpendicular plane of a seat 20 in the rocker arm 1. More specifically, in the embodiment shown the second seat part 17 of the cartridge comprises an outer circumferential ledge 19 with an axially perpendicular plane and a corresponding axially perpendicular plane of a seat 20 in the rocker arm 1.

As indicated in FIGS. 2 and 3, the cartridge 13 has outer threads 21 for engaging with inner threads 22 of the recess 5 in the rocker arm 1. More specifically in the embodiment shown, the first part 16 of the cartridge 13 has outer threads 21 for engaging with inner threads 22 of the recess 5 in the rocker arm 1.

In the shown embodiment, the first end of the cartridge 13 has a structure 23 allowing for engagement with a tool, in this case a torx key. Thus, when assembling the valve system, a torx key is used to screw the cartridge 13 into the recess 5. The torque applied should be adapted to the desired sealing function of the circumferential ledge 19 of the second seat part 17 with an axially perpendicular plane of the cartridge against the corresponding axially perpendicular plane of the seat 20 in the rocker arm 1. For making sure the cartridge 13 does not unscrew itself from the recess 5 it could for instance be soldered or welded to the rocker arm 1.

It is to be understood that the present invention is not limited to the embodiments described above and illustrated in the drawings; rather, the skilled person will recognize that many changes and modifications may be made within the scope of the appended claims. For example, the structure 23 of the cartridge 13 could be of another type, for instance an outer hexagon shape such that the cartridge 13 is instead screwed into the recess 5 with a wrench.

The invention claimed is:

1. A valve mechanism system for a hydraulic rocker arm of a combustion engine, the valve mechanism system comprising:

recess arranged in the rocker arm, the recess including a first opening fluidly connected to a hydraulic element via a rocker arm channel, and a second opening fluidly connected to a rocker arm oil supply via a second channel;

a first seat arranged in the recess;

a check valve spring arranged in the first seat;

a check valve ball arranged in the first seat so as to be in contact with the check valve spring, the check valve ball configured to be switched between (i) a first position in which a flow of oil between the first and second openings is enabled, and (ii) a second position in which the flow of oil between the first and second openings is prevented;

a cylindrical cartridge arranged in the recess, the cartridge including a first p t arranged towards an outside of the rocker arm, and a separately formed second seat part extending towards an inner end of the recess;

a control piston slidably arrange d in the first part, the control piston including a first end with an axially extending pin configured to engage the check valve ball at a position opposite to the check valve spring, and a control piston spring pressed between the first part and a second end of the control piston so as to bias the control piston towards the check valve ball, wherein the first part includes outer threads configured to engage in breads of the recess, wherein the second seat part includes at least one radial opening corresponding to the second opening of the recess so as to convey the flow of oil when the check valve ball is in the first position, and wherein the first part is preassembled to the second seat part such that a torque the first part adjusts a sealing function of the second seat part against the recess.

2. The valve mechanism system according to claim 1, wherein the hydraulic element is a piston of the rocker arm.

3. The valve mechanism system according to claim 1, wherein the second seat part further includes an axial opening, and wherein a diameter of axial opening is greater than a diameter of the pin and less than a diameter of the control piston.

4. The valve mechanism system according to claim 1, wherein the second seat part further includes a second seat configured to receive the check valve ball when in the second position.

5. The valve mechanism system according to claim 1, wherein the cartridge further includes an outer circumferential ledge, and wherein the recess further includes a third seat configured to engage the ledge.

6. The valve mechanism system according to claim 1, wherein the second seat part further includes an outer circumferential ledge, and wherein the recess further includes a third seat configured to engage the ledge.

7. The valve mechanism system according to claim 1, wherein the first part further includes a tool engagement structure configured to be engaged by a tool which applies the torque to the first part.

* * * * *